US005810555A

United States Patent [19]

Savage et al.

[11] Patent Number: 5,810,555

[45] Date of Patent: Sep. 22, 1998

[54] HIGH-PUMPING FAN WITH RING-MOUNTED BLADELETS

[75] Inventors: John R. Savage, Kettering; Michael J. Neely, Dayton, both of Ohio

[73] Assignee: ITT Automotive Electrical Systems, Inc., Auburn Hills, Mich.

[21] Appl. No.: 854,548

[22] Filed: May 12, 1997

[51] Int. Cl.[6] ..... F04D 29/38

[52] U.S. Cl. ..... 416/189

[58] Field of Search ..... 416/169 A, 179, 416/189

[56] References Cited

U.S. PATENT DOCUMENTS 5,454,695 10/1995 Shah et al. .

OTHER PUBLICATIONS

Bill Gunston, *Aircraft of World War 2*, p. 194, Published by Crescent Books, New York (1980).

*Primary Examiner*—John T. Kwon

*Attorney, Agent, or Firm*—Thomas N. Twomey; J. Gordon Lewis

[57] ABSTRACT

A vehicle fan assembly for circulating air to cool an engine. The fan assembly has a central hub; an outer, circumferential ring with an inner surface disposed around the hub; a plurality of blades, each blade having a root connected to the hub, a tip connected to the inner surface of the ring, and a span between the root and the tip, the blades extending generally radially outward from the hub to the ring; and at least one bladelet having a base connected to the inner surface of the ring, a free end, and a span between the base and the free end. Preferably, a plurality of bladelets are disposed alternately with the blades on the inner surface of the ring around the circumference of the ring. The span of each bladelet is about 40% to 50% of the span of the blades. The tips of the blades and the bases of the bladelets are connected to the ring over the full width of the blades and the bladelets, respectively. Finally, each bladelet has a planform with an elliptical profile.

15 Claims, 8 Drawing Sheets

HIGH-PUMPING FAN WITH RING-MOUNTED BLADELETS

FIELD OF THE INVENTION

This invention relates generally to a vehicle engine-cooling fan assembly and, more particularly, to the aerodynamics of such an assembly. Small blades, or "bladelets," are attached to the inner surface of the circumferential ring of the fan assembly to achieve a fan assembly having high pumping without excessive blade crowding, pitch angle, camber, or axial depth.

BACKGROUND OF THE INVENTION

A conventional, multi-blade cooling air fan assembly 10 is shown in FIG. 1. Designed for use in a land vehicle, fan assembly 10 induces air flow through a heat exchanger to cool the engine. Fan assembly 10 has a hub 12 and an outer, rotating, circumferential ring 14 that prevents the passage of recirculating flow from the outlet to the inlet side of the fan. A plurality of blades 100 (nine are shown in FIG. 1) extend radially from hub 12 (where the root of each blade 100 is joined) to ring 14 (where the tip of each blade 100 is joined).

Fan assembly 10 rotates about an axis 20 that passes through the center of hub 12 and is perpendicular to the plane of fan assembly 10 in FIG. 1. As fan assembly 10 rotates about the axis, in the counter-clockwise direction illustrated by arrow 16, the mechanical power imparted to fan assembly 10 (from a fan clutch, an electric motor, an hydraulic motor, or some other source) is converted to flow power. Flow power is defined as the product of the volumetric flow rate and the pressure rise generated by fan assembly 10. Efficiency is defined as the ratio of flow (output) power to motor (input) power.

Fan assembly 10 must accommodate a number of diverse considerations. For example, when fan assembly 10 is used in an automobile or truck, it is typically placed behind a heat exchanger which may be the radiator, the air conditioning condenser, or both. Consequently, fan assembly 10 must be compact to meet space limitations in the engine compartment. Fan assembly 10 must also be efficient, avoiding wasted energy which directs air in turbulent flow patterns away from the desired axial flow; relatively quiet; and strong to withstand the considerable loads generated by air flows and centrifugal forces.

Fan assembly 10 of FIG. 1 is an axial fan; that is, an air particle moving through fan assembly 10 traverses a path roughly parallel to the axis of rotation 20. The flow power produced by fan assembly 10 is proportional to the turning of the air as it passes from the inlet to the outlet plane. This turning is achieved by curved, or cambered, blade cross sections (also known as airfoils). In summary, blades 100 turn the air stream through fan assembly 10, thereby creating a pressure rise across the assembly.

FIG. 2 illustrates an airfoil 30 of blade 100 having a leading edge 32, a trailing edge 34, and substantially parallel surfaces 36 and 38. The chord of airfoil 30 is the straight line (represented by the dimension "c") extending directly across the airfoil from leading edge 32 to trailing edge 34. The camber is the arching curve (represented by the dimension "b") extending along the center or mean line 40 of airfoil 30 from leading edge 32 to trailing edge 34. Camber is measured from a line extending between the leading and trailing edges of the airfoil (i.e., the chord length) and mean line 40 of airfoil 30. Maximum camber, $b_{max}$, is the perpendicular distance from the chord line, c, to the point of maximum curvature on the airfoil mean line 40. A high camber provides high lift and, up to a limit, fan pumping is proportional to maximum airfoil camber. Excessive camber can produce separated flow, however, and a decrease in pumping.

As shown in FIG. 3, when airfoil 30 contacts a stream of air 18, the air stream engages leading edge 32 and separates into streams 42 and 44. Stream 42 passes along surface 36 while stream 44 passes along surface 38. As is well known, stream 42 travels a greater distance than stream 44, at a higher velocity, with the result that air adjacent to surface 36 is at a lower pressure than air adjacent to surface 38. Consequently, surface 36 is called the "suction side" of airfoil 30 and surface 38 is called the "pressure side" of airfoil 30. The pressure differential creates lift.

The operation of blade 100 having airfoil 30 can be illustrated using an inlet velocity diagram as shown in FIG. 2. The linear blade speed is represented by ωr, where omega (ω) is the angular speed of the blade and r is the radius. In an axial flow fan assembly 10, the air flow has components of velocity parallel to the axis of rotation of fan assembly 10 ($V_{ax}$) and to the tangential direction ($V_{tan}$)—but has little radial velocity. It is desirable to distinguish between the absolute velocity, $V_{abs}$, and the velocity relative to the moving blade 100, $V_{rel}$. The angle of attack for air stream 18 is represented by alpha (α) and theta (θ) is the pitch angle of blade 100.

The pitch angle is an important parameter in fan design. For a given constant-radius section, the blade pitch is set such that the airfoil angle of attack, α, produces the desired lift coefficient ($C_L$). Note that the cambered section "turns" the air as it passes from the inlet to the outlet plane; the airfoil lift, $C_L$, and the fan pumping (pressure rise), are proportional to the turning of the relative velocity vector ($V_{rel}$ in FIG. 2). Specifically, an increase in fan pressure rise can be achieved by increasing airfoil pitch angle or camber.

An airfoil of blade 100 which provides higher camber and increased lift than another airfoil can be pitched at a lower angle of attack, therefore, to provide the same lift as the other airfoil. This is illustrated by FIG. 4, which is a graph of coefficient of lift, $C_L$, versus angle of attack, α, for an airfoil with higher and lower camber. The efficiency of the airfoil then increases as the angle of attack decreases. There are practical limitations, however, to the magnitude of camber and pitch angle that can be used in any fan application. If either the camber or the pitch angle is too large, flow separation can occur, resulting in a decrease in both fan pumping and efficiency.

In addition, the axial depth of the blade (and fan) increases in proportion to the blade pitch angle. This is an important consideration in modern automotive applications, where axial space can be very limited. Reduction of the attack angle permits reduction of the axial depth of ring 14 of fan assembly 10. This advantage is illustrated in FIGS. 5*a* and 5*b* (both figures depict ring 14 rotating clockwise, when ring 14 is viewed from above, around its central axis). FIG. 5*a* shows the axial depth, $x_1$, of ring 14 when the airfoil has a high angle of attack. FIG. 5*b* shows the axial depth, $x_2$, of ring 14 when the airfoil has a lower angle of attack. Clearly, $x_2$ is less than $x_1$. RL is the radius of the ring inlet.

To overcome the shortcomings of conventional fan assemblies, a new fan assembly is provided. An objective of the present invention is to provide an engine-cooling fan assembly, including a plurality of blades and bladelets, having high operational and air-pumping efficiency. A related objective is to select a bladelet planform that minimizes vorticity near the ring of the fan assembly. A second related objective is to provide an engine-cooling fan assembly that provides high pressure rise across the fan assembly at low blade pitch angles. Another objective is to increase pumping without an increase in fan axial depth. Still another objective is to reduce the noise created by, and the rotational speed of, the fan assembly. Yet another objective of the present invention is to provide a fan assembly in which the solidity is more nearly uniform from hub to ring. Finally, it is an objective of the present invention to provide a fan assembly—having high pumping without excessive blade crowding, pitch angle, camber, or axial depth—suitable for the entire range of engine-cooling fan assembly operation, including idle.

SUMMARY OF THE INVENTION

To achieve these and other objectives, and in view of its purposes, the present invention provides a vehicle fan assembly for circulating air to cool an engine. The fan assembly has a central hub; an outer, circumferential ring with an inner surface disposed around the hub; a plurality of blades, each blade having a root connected to the hub, a tip connected to the inner surface of the ring, and a span between the root and the tip, the blades extending generally radially outward from the hub to the ring; and at least one bladelet having a base connected to the inner surface of the ring, a free end, and a span between the base and the free end. Preferably, a plurality of bladelets are disposed alternately with the blades on the inner surface of the ring around the circumference of the ring. The span of each bladelet is about 40% to 50% of the span of the blades. The tips of the blades and the bases of the bladelets are connected to the ring over the full width of the blades and the bladelets, respectively. Finally, each bladelet has a planform with an elliptical profile.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing, in which.

Figure 1:
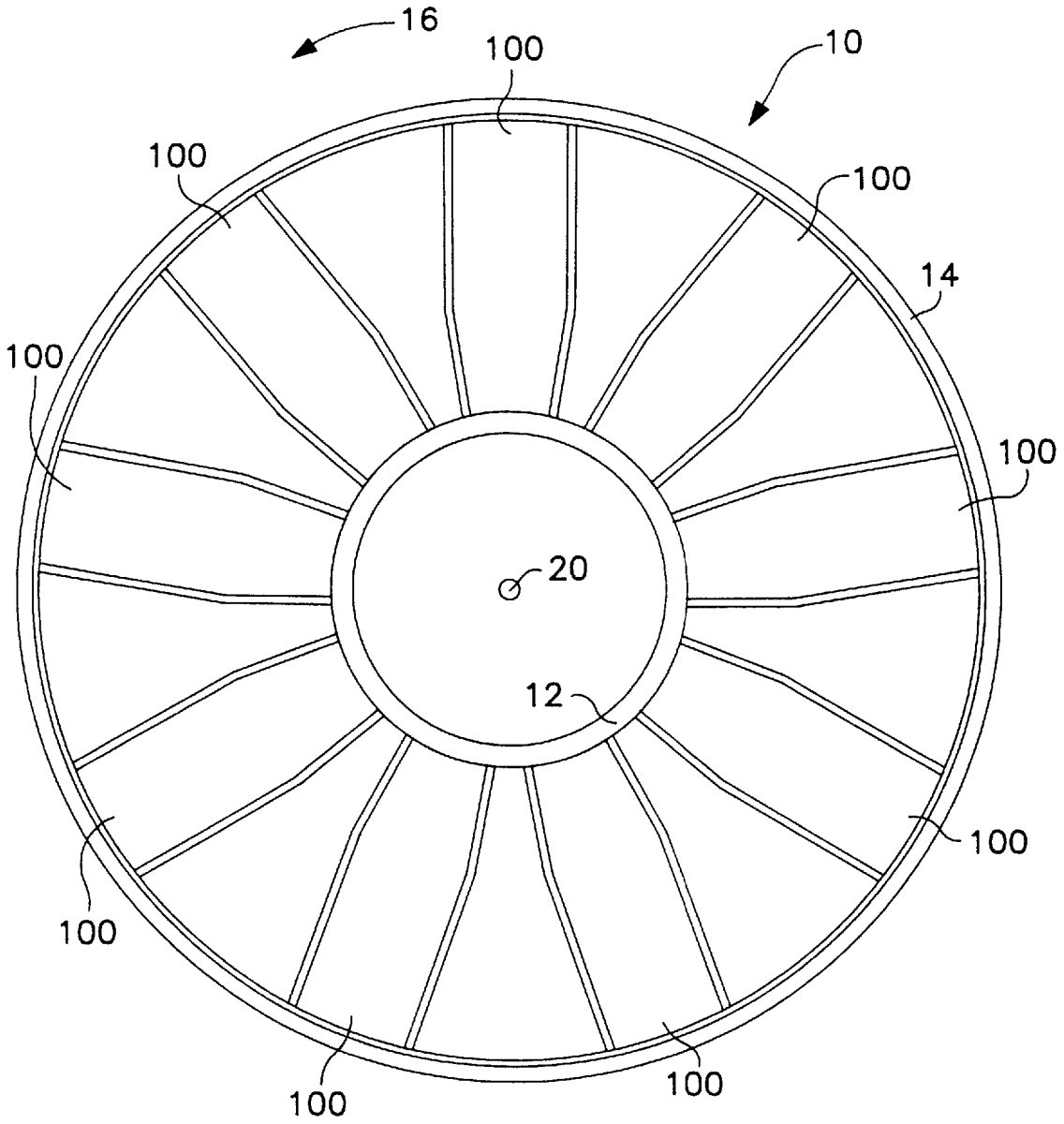
FIG. 1 (PRIOR ART)
FIG. 1 is a front elevational view of a conventional cooling air fan assembly having nine straight-planform blades.
Figure 2:
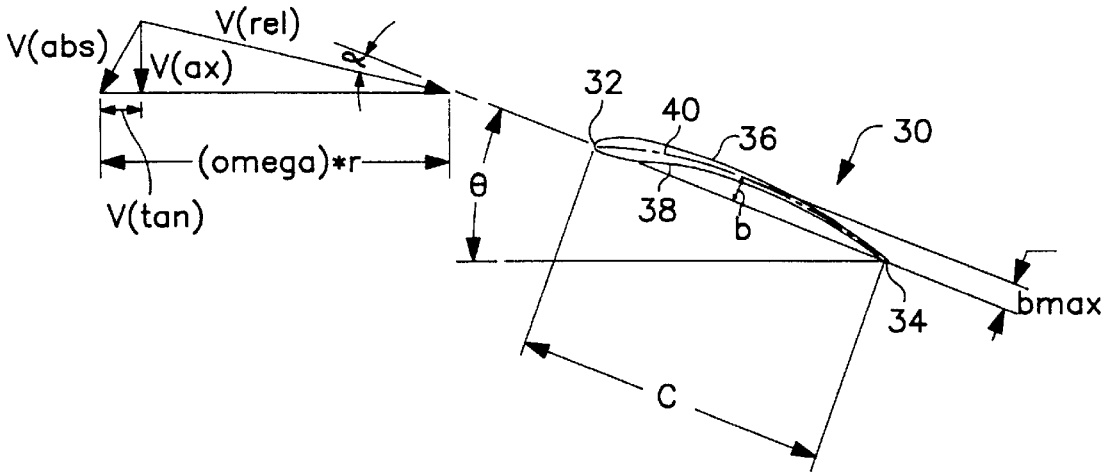
FIG. 2 (PRIOR ART)
FIG. 2 is a cross-sectional view of an airfoil of a blade illustrating an exemplary inlet velocity triangle.
Figure 3:
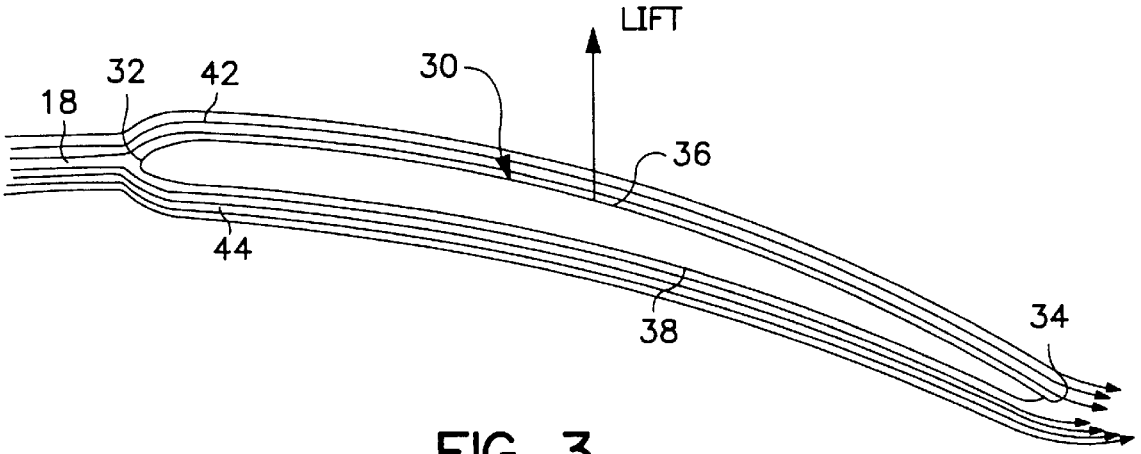
FIG. 3 (PRIOR ART)
FIG. 3 illustrates the airfoil, shown in FIG. 2, in an air stream.
Figure 4:
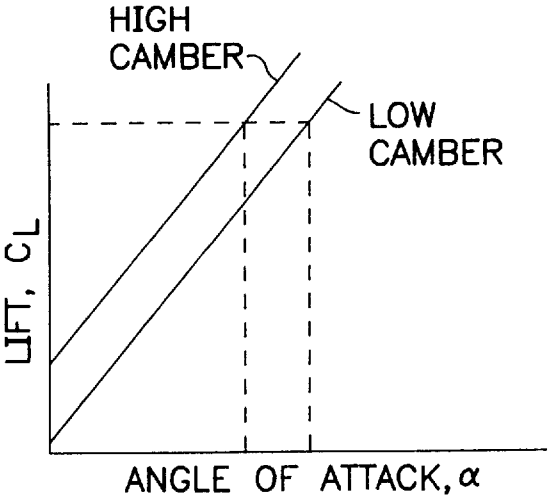
FIG. 4 (PRIOR ART)
FIG. 4 is a graph of coefficient of lift, $C_L$, versus angle of attack, $\alpha$, for an airfoil with higher and lower camber.
Figure 5B:
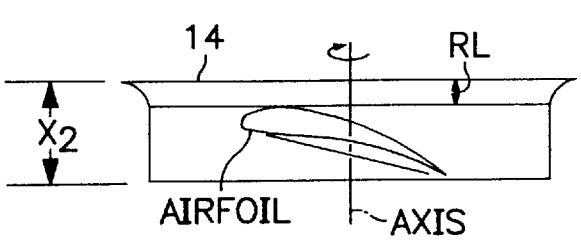
FIG. 5B (PRIOR ART)
FIG. 5*b* shows the axial depth of the ring of the fan assembly of FIG. 1 when the airfoil has a low angle of attack.
Figure 5A:
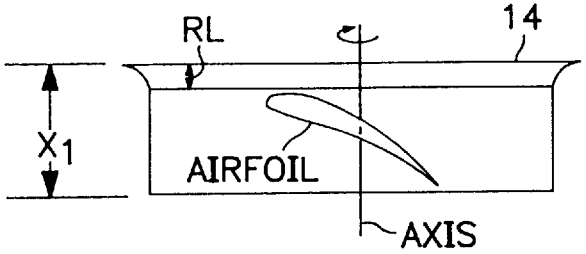
FIG. 5A (PRIOR ART)
FIG. 5*a* shows the axial depth of the ring of the fan assembly of FIG. 1 when the airfoil has a high angle of attack.

It is emphasized that, according to common practice, the various features of the drawing are not to scale. On the contrary, the width, length, and thickness of the various features are arbitrarily expanded or reduced for clarity.

DETAILED DESCRIPTION OF THE INVENTION

High-pumping axial fan assemblies are required for many applications, including engine-cooling fan assemblies 10 for automobiles and trucks. Fan assemblies 10 must produce a high pressure rise at a given air flow rate, which is usually accomplished by using a large number of blades 100, high blade pitch angle ($\theta$), or a large tip diameter. But space restrictions under the hood may prevent the use of fan assemblies 10 with high blade pitch angles (which results in greater axial depth) or large tip diameters.

When too many blades 100 are placed around the fan hub 12, a condition known as "crowding" can occur. Crowding refers to the ratio of blade chord (distance from leading to trailing edge) to gap (circumferential distance between adjacent blades), measured at a given radius, r. Excessive crowding can result in a decrease in pumping and efficiency.

If straight-planform, constant-chord blades are used, the gap between adjacent blades is proportional to the local radius, r. Therefore, more space is available at larger radii (near the tip) than at smaller radii (near the root). The present invention makes use of the relatively large gaps near the outer fan diameter, by adding small, ring-mounted "bladelets" to provide increased pumping without adversely affecting efficiency.

Figure 6:
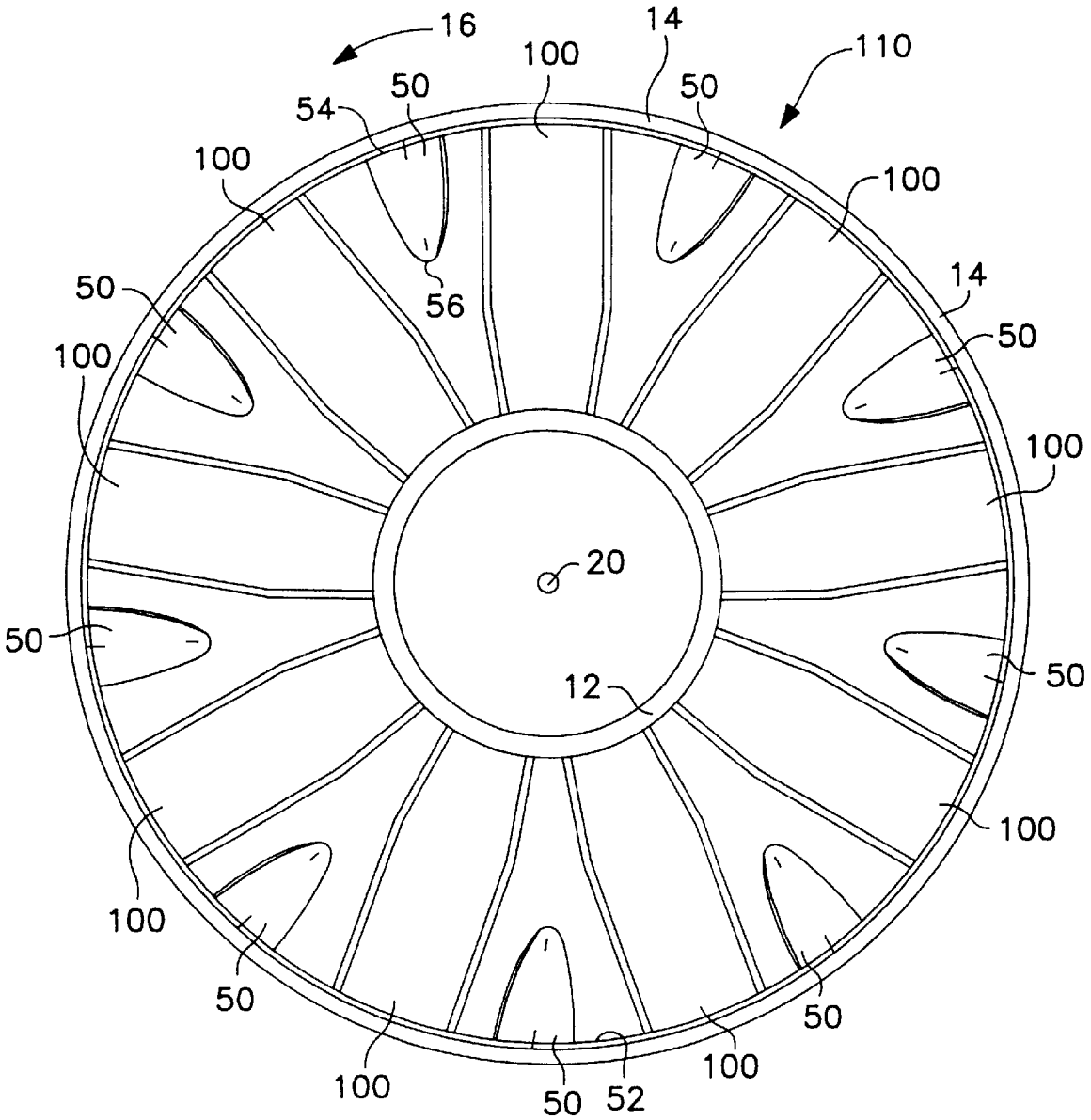
FIG. 6 illustrates the circumferential ring of the fan assembly shown in FIG. 1 having a number of small blades, or "bladelets," attached to the inner surface of the ring according to the present invention.

Focusing now on the present invention, FIG. 6 shows ring 14 of the fan assembly 110 having a number of small blades, or "bladelets" 50, attached to the inner surface 52 of ring 14. Fan assembly 110 with bladelets 50 produces high pumping without excessive blade crowding, pitch angle, camber, or axial fan depth. Each bladelet 50 has a base 54 and a free end 56, and defines a span between base 54 and free end 56.

Bladelets 50 are located between the larger, primary fan blades 100. Preferably, bladelets 50 and blades 100 alternate around the circumference of ring 14. Also preferably, bladelets 50 have a span of roughly 40% to 50% of the primary blade span. Fan assembly 110 is illustrated with nine, straight-planform primary blades 100 and nine bladelets 50 for purposes of example only; the number of blades 100 and bladelets 50 may vary depending upon the particular application. In addition, the number of blades 100 and bladelets 50 need not be equal.

The tips of blades 100 and the bases 54 of bladelets 50 are joined or connected to ring 14 over the full width of blades 100 and bladelets 50, respectively, and not at a single point or over a narrower section joining or connecting ring 14. This form of joint or connection is important in controlling the circulation of the air from pressure (working) surface 38 to suction surface 36 of blades 100. It also assists in directing the air onto pressure surface 38 of blades 100 with a minimum of turbulence. Finally, the support provided by ring 14 provides strength to blades 100 and bladelets 50.

Ring 14 also improves fan efficiency. Besides adding structural strength to fan assembly 110 by supporting blades 100 at their tips and bladelets at their bases 54, ring 14 holds the air on pressure surface 38 of blades 100 and, in particular, prevents the air from flowing from pressure surface 38 to suction surface 36 of blades 100 by flowing around the outer ends of blades 100. Ring 14 preferably has a cross-sectional configuration that is thin in the radial direction while extending in the axial direction a distance at least equal to the axial width of blades 100 at their tips.

Fan assembly 110 with ring-mounted bladelets 50 provides more-uniform solidity from root to tip. Solidity, σ, is a measure of blade crowding, defined as:

$$\sigma = \frac{c}{\frac{2}{N}\pi r},$$

where c is the blade chord, N is the number of blades, and r is the local radius. Without the ring-mounted bladelets 50, solidity decreases linearly from root to tip. Low tip solidity has a detrimental effect on fan pumping, because the high-radius portion of blade 100, where ωr is highest, is the region with the greatest capacity for pumping.

Figure 7A:
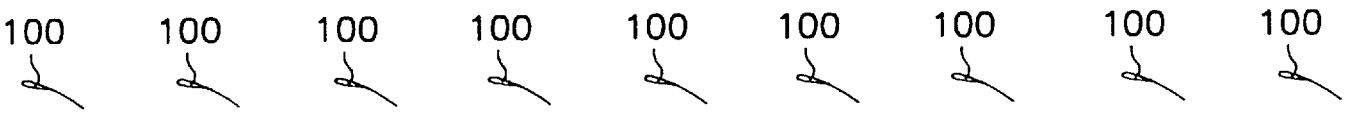
FIG. 7A (PRIOR ART)
FIG. 7*a* illustrates an "unwrapped," constant-radius section of the conventional, nine-blade fan assembly shown in FIG. 1.
Figure 7B:
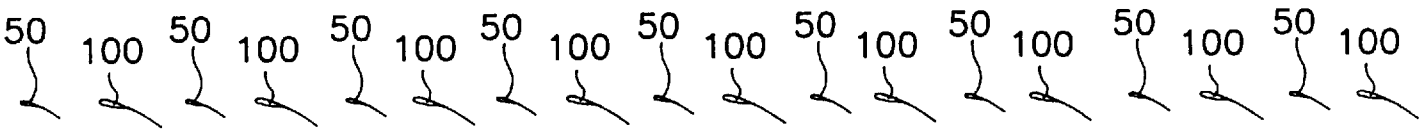
FIG. 7*b* illustrates an "unwrapped," constant-radius section of the nine-blade and nine-bladelet fan assembly shown in FIG. 6 according to the present invention.

A comparison of near-tip blade solidity for a fan assembly both with and without bladelets 50 is shown in FIGS. 7*a* and 7*b*. In FIG. 7*a*, an "unwrapped," constant-radius section of the conventional, nine-blade fan assembly 10 of FIG. 1 is shown. The same constant-radius section of fan assembly 110 with bladelets 50 (FIG. 6) is shown in FIG. 7*b*. It is clear from this comparison that fan assembly 110 having bladelets 50 provides substantially higher solidity in the highest 40% to 50% of the blade span.

Note that the use of bladelets 50 increases solidity near the tip of blades 100, where it is needed to produce pumping, without creating excessive blade crowding near the root of blades 100. Therefore, an increase in pumping is obtained without an increase in fan axial depth. In fact, it will be demonstrated that fan assembly 110 with both primary blades 100 and bladelets 50 produces higher pressure rise at lower pitch angles than a similar fan assembly 10 with only primary blades 100.

Figure 8:
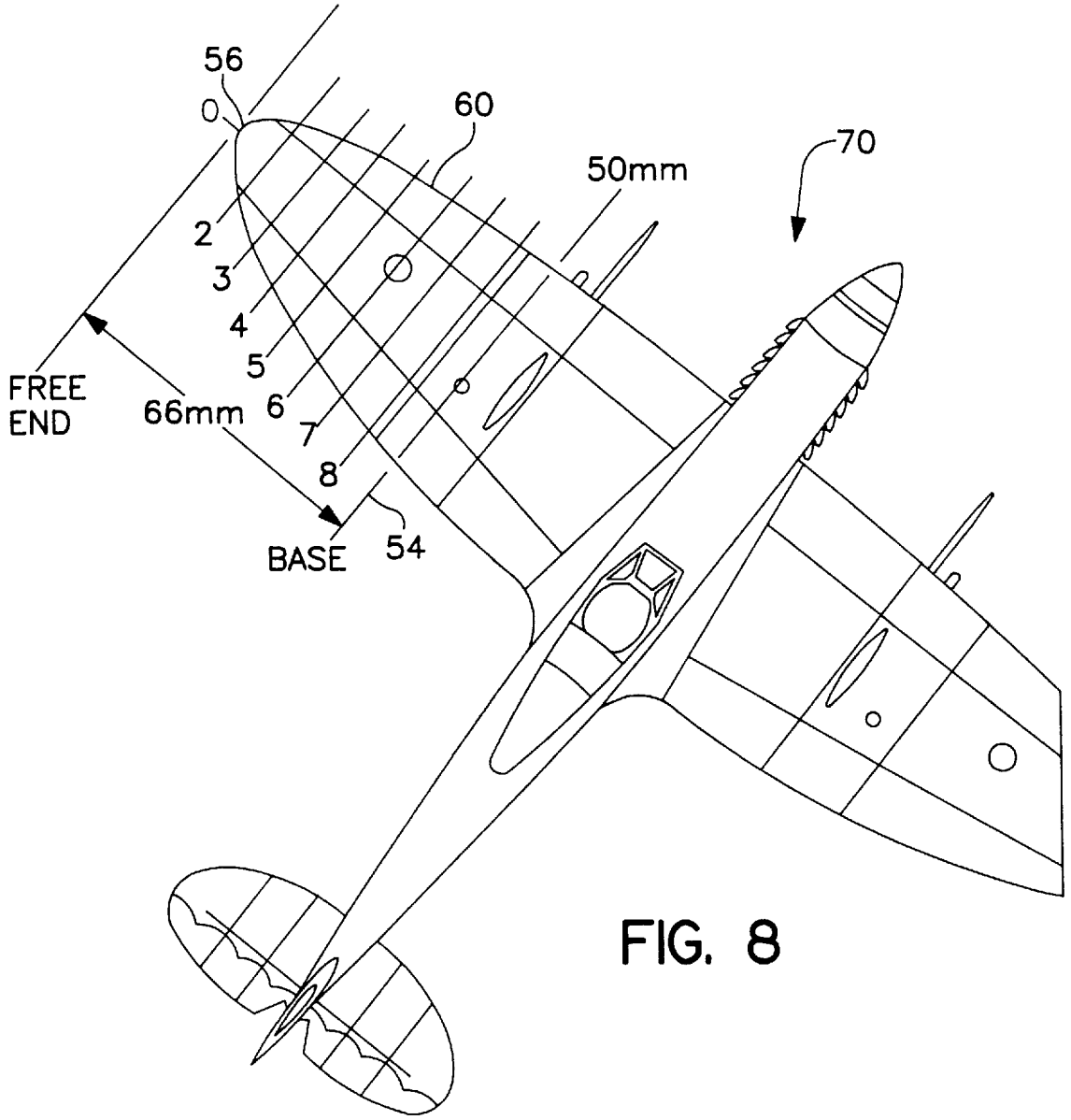
FIG. 8 depicts the wing of the Supermarine Spitfire airplane, illustrating the preferred planform geometry of the bladelets of the present invention.

The present invention encompasses any fan assembly 110 having bladelets 50 mounted to ring 14, regardless of the planform geometry or span of bladelets 50. Nevertheless, a preferred planform shape of bladelets 50 was selected for testing purposes. For the first prototype, a bladelet planform was chosen that would produce a small tip vortex. The planform geometry selected was that of the wing 60 of the Supermarine Spitfire airplane 70, as shown in FIG. 8. The Spitfire wing 60, with its well-known elliptical profile, produces minimum vorticity at the blade tip.

The tip vortex of bladelet 50 produces "downwash" at adjacent sections, reducing the lift generated at these adjacent sections. Furthermore, the tip vortex of bladelet 50 could distort the flow from neighboring primary blades 100, resulting in a decrease in fan efficiency. For these two reasons, the tip vortex of bladelet 50 should be reduced as much as possible. Elliptical wing (or blade) 60, as proven in aerodynamic theory, produces a tip vortex of lower strength than other wing (or blade) profiles.

Thus, the preferred planform of bladelet 50 is an elliptical shape, modeled after Supermarine Spitfire wing 60 shown in FIG. 8. The elliptical shape is ideally suited to the bladelet application, in which free end 56 of bladelet 50 extends into air stream 18 and is unsupported by hub 12. With base 54 having a chord of about 50 mm and free end 56 tapering to zero chord, the tip roll-over vortex is of very low strength; this is a favorable condition, reducing interference between the bladelet tip vortex and the inlet air stream of the adjacent large blade 100.

The following table shows the distribution of bladelet airfoil chord (represented by the ratio of the chord, c, at a specific radial location to the chord, $c_b$, at base 54 of bladelet 50) as a function of radial location (represented by the ratio of the radius, r, at a specific radial location to the radius, $r_b$, at base 54 of bladelet 50) along the span. The span is about 66 mm. The subscript "b" refers to the base 54 of bladelet 50, i.e., the bladelet end that is attached to ring 14.

| Section | $r/r_b$ | $c/c_b$ |
|---|---|---|
| 1 (base) | 1.000 | 1.000 |
| 2 | 0.967 | 0.956 |
| 3 | 0.934 | 0.897 |
| 4 | 0.900 | 0.845 |
| 5 | 0.867 | 0.760 |
| 6 | 0.834 | 0.666 |
| 7 | 0.801 | 0.553 |
| 8 | 0.768 | 0.388 |
| 9 (free end) | 0.734 | 0.000 |

A prototype fan assembly 110, with nine primary blades 100 and nine ring-mounted bladelets 50 (see FIG. 6), was built with nylon blades 100, nylon bladelets 50, a machined aluminum hub 12, and a formed aluminum ring 14. The tip pitch angle of both bladelets 50 and primary blades 100 was 21°. The identification number of fan assembly 110 was EF1021 ("EF" designates an experimental fan assembly).

A baseline fan assembly 10 with nine blades 100 (see FIG. 1) was built with nylon blades 100, a machined aluminum hub 12, and a formed aluminum ring 14. The tip pitch angle of blades 100 was 23°, a 2° increase over fan assembly 110 with ring-mounted bladelets 50. The identification number of baseline fan assembly 10 was EF1022.

As stated above, the blade pitch angle of baseline fan assembly 10 (EF1022) is 2° higher than the blade pitch angle of fan assembly 110 with ring-mounted bladelets 50 (EF1021). The difference in pitch angle attempts to achieve equal pumping performance for the two fan assemblies. If the two fan assemblies were built with equal blade pitch angles, fan assembly 110 with ring-mounted bladelets 50, with its higher solidity near the tip, would yield higher pumping than would baseline fan assembly 10.

Figure 9:
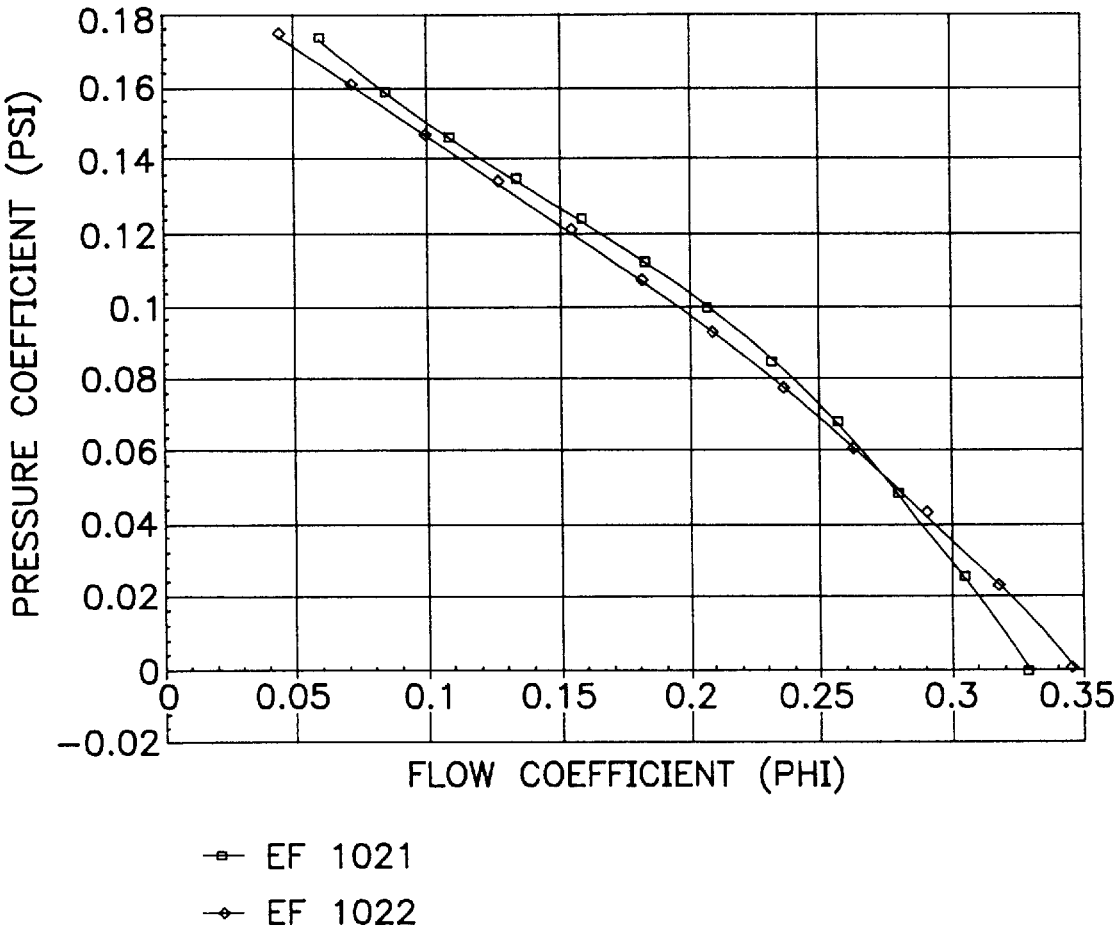
FIG. 9 is a graph of pressure coefficient, $\psi$, versus flow coefficient, $\phi$, comparing fan assemblies with and without the bladelets of the present invention.

FIG. 9 is a graph of pressure coefficient, ψ, versus flow coefficient, ϕ, for the two fan assemblies 110 and 10 (EF1021 and EF1022, respectively). Both fan assemblies were run at 1800 rpm and were mounted behind two heat exchangers in series (one radiator and one condenser). The graph shows that fan assembly 110 with ring-mounted bladelets 50 has higher pressure rise over most of the operating range, from ϕ≈0.06 to ϕ≈0.27. The variables ψ and ϕ are non-dimensional expressions of pressure rise and flow rate, respectively, defined as:

$$\psi = \frac{\Delta P}{\rho U_t^2}, \text{ and}$$

$$\phi = \frac{QH}{U_t D_t^2}.$$

In the equations above, ΔP is the fan static pressure rise, ρ is the air density, $U_t$ is the blade tip speed, $D_t$ is the tip diameter, and Q is the volumetric air flow rate. The variable H is needed to account for the presence of hub 12 in the air stream, and is defined as:

$$H = \frac{1}{1 - (D_h/D_t)^2} .$$

In the equation immediately above, $D_h$ is the hub diameter.

Figure 10:
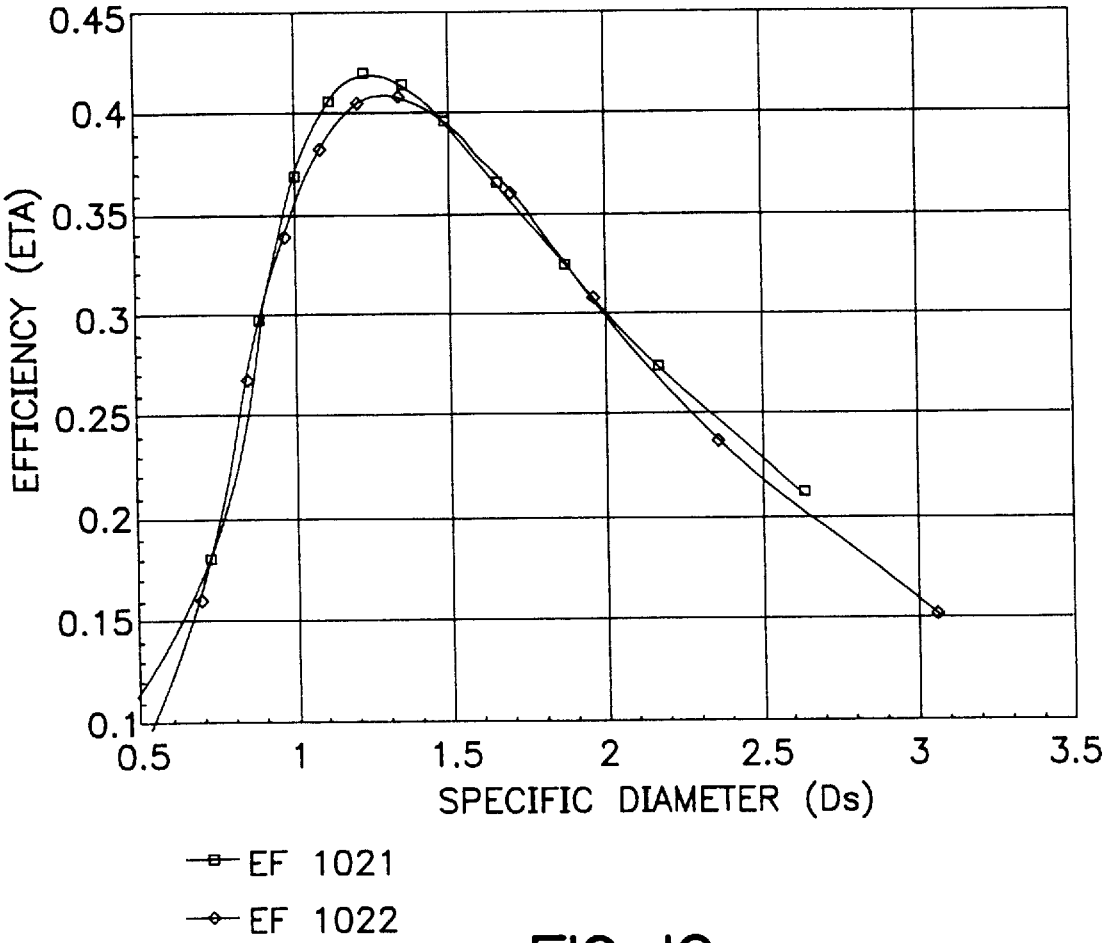
FIG. 10 is a graph of efficiency, $\eta$, versus specific diameter, $D_S$, comparing fan assemblies with and without the bladelets of the present invention.

Not only does fan assembly 110 with ring-mounted bladelets 50 (EF1021) produce higher pressure rise than baseline fan assembly 10 (EF1022), it is also more efficient. In FIG. 10, efficiency, η, is plotted against specific diameter, $D_S$, where:

$$\eta = \frac{Q\Delta P}{M} \text{, and}$$

$$D_s = \frac{\psi^{1/4}}{\phi^{1/2}} .$$

In the first equation, M is the fan input power, supplied by a fan clutch, an electric motor, an hydraulic motor, or some other source. The specific diameter, $D_S$, a non-dimensional ratio of pressure rise to flow rate, is a convenient expression of the fan operating point.

The graphs of FIGS. 9 and 10 show the improved performance of fan assembly 110 having bladelets 50 according to the present invention. This improvement is achieved with less axial fan depth than baseline fan assembly 10. For example, the prototype fan assembly 110 with ring-mounted bladelets 50, EF1021, has a tip chord, $c_t$, of 77.0 mm and a tip pitch angle, $\theta_t$, of 21°. This combination of chord and pitch angle results in a blade axial depth of 27.6 mm. The baseline fan assembly 10 (EF1022), with the same tip chord (77.0 mm) and a tip pitch angle of 23°, has a blade axial depth of 30.1 mm. Therefore, in this particular application, fan assembly 110 with ring-mounted bladelets 50 provides a reduction in blade axial depth of 2.5 mm. Fan axial depth is often a critical factor in the design of automotive cooling assemblies.

The pressure rise versus flow graph of FIG. 9 shows the higher pumping of fan assembly 110 with ring-mounted bladelets 50. To provide an air flow rate equal to baseline fan assembly 10 (EF1022), fan assembly 110 with ring-mounted bladelets 50 (EF1021) must be operated at a lower rotational speed. A computer program was used to analyze the data obtained from tests run on prototype fan assembly 110 (EF1021) and baseline fan assembly 10 (EF1022). The fan speed of prototype fan assembly 110 (EF1021) required to match the flow of baseline fan assembly 10 (EF1022) at a single operating point ($D_S$=1.25) and baseline fan speed (N=2500 rpm) was calculated from the data using the program. The program output for the equal-airflow case is given in the table below:

| | Baseline Fan EF1022 | Fan with Bladelets EF1021 |
|---|---|---|
| $D_S$ | 1.25 | 1.25 |
| Q (cmm) | 130.77 | 130.74 |
| ΔP (kPa) | 0.4734 | 0.4734 |
| N (rpm) | 2500 | 2456 |
| M (Watts) | 2518 | 2460 |
| η | 0.411 | 0.420 |

The data show that, for the $D_S$=1.25 operating point and a baseline fan speed of 2500 rpm, fan assembly 110 with ring-mounted bladelets 50 supplies the same air flow rate at a speed 44 rpm lower than baseline fan assembly 10. Due to the decrease in rotating speed, fan assembly 110 with ring-mounted bladelets 50 produces less airborne noise than baseline fan assembly 10. Furthermore, fan assembly 110 with ring-mounted bladelets 50 matches the baseline-fan pumping with a 58 Watt decrease in fan input power, yielding an efficiency gain of approximately 0.9% over baseline fan assembly 10.

In summary, fan assembly 110 was built with nine primary blades 100 having straight planforms and nine smaller, secondary, ring-mounted bladelets 50 with elliptical planforms. Prototype fan assembly 110 with ring-mounted bladelets 50 exhibited superior performance (equal pumping with increased efficiency, decreased rotating speed, and decreased noise level), and reduced packaging depth, when compared with baseline fan assembly 10 with nine primary blades 100.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention. Although the tip pitch angles of the primary blades and the bladelets were equal on the prototype fan assembly described above (EF1021), for example, the present invention also applies to fan assemblies with bladelet pitch angles different from the primary blade pitch angles. Finally, the present invention encompasses bladelet and primary blade planform shapes different from those described above (e.g., blades with forward sweep, backward sweep, or some combination of forward and backward sweep).

What is claimed is:

1. A vehicle fan assembly for circulating air to cool an engine, said fan assembly comprising:

a central hub;

an outer, circumferential ring having an inner surface and being disposed around said hub;

a plurality of blades, each blade having a root connected to said hub, a tip connected to said inner surface of said ring, and a span between said root and said tip, said blades extending generally radially outward from said hub to said ring; and a bladelet having a base connected to said inner surface of said ring, a free end, and a span between said base and said free end of about 40% to 50% of said span of said blades.

2. The vehicle fan assembly according to claim 1 wherein said bladelet has a planform with an elliptical profile.

3. The vehicle fan assembly according to claim 2 wherein said elliptical profile of said planform of said bladelet is defined by the following distribution of bladelet airfoil chord (represented by the ratio of the chord, c, at a specific radial location to the chord, $c_b$, at said base of said bladelet) as a function of radial location (represented by the ratio of the radius, r, at a specific radial location to the radius, $r_b$, at said base of said bladelet):

| $r/r_b$ | $c/c_b$ |
|---|---|
| 1.000 | 1.000 |
| 0.967 | 0.956 |
| 0.934 | 0.897 |
| 0.900 | 0.845 |
| 0.867 | 0.760 |
| 0.834 | 0.666 |
| 0.801 | 0.553 |
| 0.768 | 0.388 |
| 0.734 | 0.000. |

4. The vehicle fan assembly according to claim 1 wherein said tips of said blades and said base of said bladelet are connected to said ring over the full width of said blades and said bladelet, respectively.

5. The vehicle fan assembly according to claim 1 further comprising a plurality of bladelets, said bladelets and said blades alternately disposed on said inner surface of said ring around the circumference of said ring.

6. The vehicle fan assembly according to claim 2 wherein said tips of said blades and said base of said bladelet are connected to said ring over the full width of said blades and said bladelet, respectively.

7. The vehicle fan assembly according to claim 6 wherein said elliptical profile of said planform of said bladelet is defined by the following distribution of bladelet airfoil chord (represented by the ratio of the chord, c, at a specific radial location to the chord, $c_b$, at said base of said bladelets) as a function of radial location (represented by the ratio of the radius, r, at a specific radial location to the radius, $r_b$, at said base of said bladelets):

| $r/r_b$ | $c/c_b$ |
|---|---|
| 1.000 | 1.000 |
| 0.967 | 0.956 |
| 0.934 | 0.897 |
| 0.900 | 0.845 |
| 0.867 | 0.760 |
| 0.834 | 0.666 |
| 0.801 | 0.553 |
| 0.768 | 0.388 |
| 0.734 | 0.000. |

8. The vehicle fan assembly according to claim 6 further comprising a plurality of bladelets, said bladelets and said blades alternately disposed on said inner surface of said ring around the circumference of said ring.

9. A vehicle fan assembly for circulating air to cool an engine, said fan assembly comprising:

a central hub;

an outer, circumferential ring having an inner surface and being disposed around said hub;

a plurality of blades, each blade having a root connected to said hub, a tip connected to said inner surface of said ring, and a span between said root and said tip, said blades extending generally radially outward from said hub to said ring; and a plurality of bladelets each having a base connected to said inner surface of said ring, a free end, a span between said base and said free end about 40% to 50% of said span of said blades, and a planform with an elliptical profile, said bladelets and said blades alternately disposed on said inner surface of said ring around the circumference of said ring.

10. The vehicle fan assembly according to claim 9 wherein said elliptical profile of said planform of said bladelets is defined by the following distribution of bladelet airfoil chord (represented by the ratio of the chord, c, at a specific radial location to the chord, $c_b$, at said base of said bladelet) as a function of radial location (represented by the ratio of the radius, r, at a specific radial location to the radius, $r_b$, at said base of said bladelet):

| $r/r_b$ | $c/c_b$ |
|---|---|
| 1.000 | 1.000 |
| 0.967 | 0.956 |
| 0.934 | 0.897 |

-continued

| $r/r_b$ | $c/c_b$ |
|---|---|
| 0.900 | 0.845 |
| 0.867 | 0.760 |
| 0.834 | 0.666 |
| 0.801 | 0.553 |
| 0.768 | 0.388 |
| 0.734 | 0.000. |

11. A vehicle fan assembly for circulating air to cool an engine, said fan assembly comprising:

a central hub;

an outer, circumferential ring having an inner surface and being disposed around said hub;

a plurality of blades, each blade having a root connected to said hub, a tip connected over the full width of said tip to said inner surface of said ring, and a span between said root and said tip, said blades extending generally radially outward from said hub to said ring; and a plurality of bladelets, each bladelet having a base connected over the full width of said bladelet to said inner surface of said ring, a free end, a span between said base and said free end about 40% to 50% of said span of said blades, and a planform with an elliptical profile defined by the following distribution of bladelet airfoil chord (represented by the ratio of the chord, c, at a specific radial location to the chord, $c_b$, at said base of said bladelet) as a function of radial location (represented by the ratio of the radius, r, at a specific radial location to the radius, $r_b$, at said base of said bladelet):

| $r/r_b$ | $c/c_b$ |
|---|---|
| 1.000 | 1.000 |
| 0.967 | 0.956 |
| 0.934 | 0.897 |
| 0.900 | 0.845 |
| 0.867 | 0.760 |
| 0.834 | 0.666 |
| 0.801 | 0.553 |
| 0.768 | 0.388 |
| 0.734 | 0.000; |

said bladelets and said blades alternately disposed on said inner surface of said ring around the circumference of said ring.

12. A vehicle fan assembly for circulating air to cool an engine, said fan assembly comprising:

a central hub;

an outer, circumferential ring having an inner surface and being disposed around said hub;

a plurality of blades, each blade having a root connected to said hub, a tip connected to said inner surface of said ring, and a span between said root and said tip, said blades extending generally radially outward from said hub to said ring; and at least one bladelet having a base connected to said inner surface of said ring, a free end, a span between said base and said free end, and a planform with an elliptical profile defined by the following distribution of bladelet airfoil chord (represented by the ratio of the chord, c, at a specific radial location to the chord, $c_b$, at said base of said bladelet) as a function of radial location (represented by the ratio of the radius, r, at a specific radial location to the radius, $r_b$, at said base of said bladelet):

| $r/r_b$ | $c/c_b$ |
|---|---|
| 1.000 | 1.000 |
| 0.967 | 0.956 |
| 0.934 | 0.897 |
| 0.900 | 0.845 |
| 0.867 | 0.760 |
| 0.834 | 0.666 |
| 0.801 | 0.553 |
| 0.768 | 0.388 |
| 0.734 | 0.000. |

13. The vehicle fan assembly according to claim 12 wherein said tips of said blades and said base of said bladelet are connected to said ring over the full width of said blades and said bladelet, respectively.

14. The vehicle fan assembly according to claim 13 further comprising a plurality of bladelets, said bladelets and said blades alternately disposed on said inner surface of said ring around the circumference of said ring.

15. The vehicle fan assembly according to claim 12 further comprising a plurality of bladelets, said bladelets and said blades alternately disposed on said inner surface of said ring around the circumference of said ring.

* * * * *